United States Patent [19]

Fuchs, Jr.

[11] 3,985,011

[45] Oct. 12, 1976

[54] CONTINUOUS EXTRUSION

[75] Inventor: Francis Joseph Fuchs, Jr., Princeton Junction, N.J.

[73] Assignee: Western Electric Company, Inc., New York, N.Y.

[22] Filed: Sept. 12, 1975

[21] Appl. No.: 612,875

[52] U.S. Cl. ..... 72/60; 72/43; 72/262; 72/270; 72/DIG. 31; 226/173

[51] Int. Cl.[2] ..... B21C 23/32; B21C 33/00

[58] Field of Search ..... 72/45, 60, 270, 284, 72/422, DIG. 31, 287, 289, 290, 291, 262, 43; 226/172, 173

[56] References Cited

UNITED STATES PATENTS

| | | | |
|---|---|---|---|
| 2,797,798 | 7/1957 | Hallden | 226/172 |
| 3,552,164 | 1/1971 | Properzi | 72/45 |
| 3,618,840 | 11/1971 | Courret | 226/172 |
| 3,680,342 | 8/1972 | Mott et al. | 226/172 |
| 3,740,985 | 6/1973 | Fuch, Jr. | 72/60 |
| 3,922,898 | 12/1975 | Voorhes | 72/262 |

*Primary Examiner*—C.W. Lanham
*Assistant Examiner*—D. M. Gurley
*Attorney, Agent, or Firm*—A. S. Rosen; D. P. Kelley

[57] ABSTRACT

Four trains of gripping element quadrants are advanced continuously around four endless paths, meeting along one length of travel common to the four paths and cooperating to form a succession of centrally apertured gripping elements moving continuously toward an extrusion die located along the common length of travel. The gripping element quadrants are driven by pinion gears, each of which engages simultaneously sets of teeth on gripping element quadrants in two adjacent trains in order to key the quadrants together and thereby prevent one quadrant from lagging another during their advance toward the die. Four guide elements extend along the paths of the gripping elements and engage simultaneously portions of the two adjacent gripping element quadrants to guide the engaged quadrants during their advance toward the die. Four endless belts are advanced with the gripping elements toward the die and serve to transmit pressure from four stationary pressure pads to the moving gripping elements. Rod of indefinite length, coated with a shear transmitting medium and extending into the central apertures of the gripping elements, is drawn along the common length of travel by means of shear forces generated in the coating by the gripping elements and transmitted to the rod as viscous drag force along the surface of the rod. Axial and normal stresses are built up in the rod to stress the rod far above its yield strength and increase its ductility, or capacity for deformation without fracture. In this state, the rod is moved through and deformed by the die.

39 Claims, 11 Drawing Figures

CONTINUOUS EXTRUSION

BACKGROUND OF THE INVENTION

1. Field of the Invention

This invention relates, broadly, to apparatus and methods for deforming a workpiece and, more particularly, to apparatus and methods for continuously extruding a rod of indefinite length to produce a wire of indefinite length.

2. Description of the Prior Art

Representative prior art showing the more-or-less continuous deformation of a workpiece in the form of a rod appears in the following patents and certificate: U.S. Pat. Nos. 2,642,280 (1953) to Fisk; U.S. Pat. No. 2,696,907 (1954) to Fisk; U.S. Pat. No. 2,736,425 (1956) to Fisk; U.S. Pat. No. 3,113,676 (1963) to Harkentider; U.S. Pat. No. 3,415,088 (1968) to Alexander et al,; U.S. Pat. No. 3,417,589 (1968) to Bobrowsky; U.S. Pat. No. 3,423,983 (1969) to Lees et al.; U.S. Pat. No. 3,434,320 (1969) to Green; U.S. Pat. No. 3,440,849 (1969) to Hardy et al,; U.S. Pat. No. 3,449,935 (1969) to McAllan; U.S. Pat. No. 3,526,115 (1970) to Armstrong et al.; U.S. Pat. No. 3,765,216 (1973) to Green; and U.S.S.R. Author's Certificate No. 176,229 (1966) to Shvarzburd.

In my prior U.S. Pat. Nos. 3,667,267 (1972); 3,731,509 (1973); 3,738,138 (1973); and 3,738,145 (1973); the first-mentioned of which was reissued as Re. 28,373 (1975), there is shown apparatus and method for the continuous steady extrusion of rod of indefinite length, employing the viscous drag force of viscous fluid circuits, portions of which flow along the surface of the rod to build up stresses in the rod and advance the rod through an extrusion die.

In another of my prior U.S. Pat. Nos. 3,696,652 (1972), there is shown apparatus and method for the continuous steady extrusion of rod of indefinite length, wherein a first clamp engageable with the surface of the rod and a deforming agency receiving and deforming the rod are moveable relative to each other and relative to a stationary second clamp engageable with the surface of the rod so as to maintain a desired relative velocity between the rod and the deforming agency.

In yet another of my prior U.S. Pat., No. 3,740,985 (1973), which was reissued as U.S. Pat. No. RE 28,795 on May 4, 1976 , there is shown apparatus and method for the continuous steady extrusion of rod of indefinite length through a deforming agency, wherein several trains of gripping elements engage the surface of the rod and advance the rod through the deforming agency while building up stress in the rod from a station upstream of the deforming agency to the deforming agency. The apparatus and method disclosed herein represent a further significant advance in the art of extrusion.

The present invention is, in general, an improvement over the apparatus and method disclosed in my U.S. Pat. No. 3,740,985 (U.S. Pat. No. RE 28,795).

BRIEF SUMMARY OF THE INVENTION

An object of the invention resides in the provision of new and improved apparatus and methods for deforming an elongated workpiece of indefinite length to produce an elongated product of indefinite length, which apparatus and methods may be utilized, for example, in the continuous extrusion of rod of indefinite length into wire of indefinite length.

The invention contemplates the provision of improved mechanism in which a number of trains of gripping element members are moved about a number of endless paths, so as to come together along corresponding portions of their endless paths to define a moving chamber for surrounding a portion of a workpiece of indefinite length and advancing the workpiece toward a deforming agency. Such mechanisms may include facilities for engaging the gripping element members of two adjacent trains of gripping element members with a common drive mechanism, e.g., by virtue of a common drive gear engaging simultaneously sets of teeth on neighboring gripping element members, in order that the gripping element members may be driven in unison without any tendency for one of the gripping element members to lag another. Such mechanisms, further, may include a number of endless belts, each operatively associated with a different one of the trains of gripping element members, which are advanced with the gripping element members toward the deforming agency, and which are adapted to transmit pressure from a number of stationary pressure pads to the advancing gripping element members. The mechanisms, still further, may include a number of guide elements which extend along the paths of the advancing gripping element members and which each engage simultaneously portions of two adjacent gripping element members to guide the engaged gripping element members during their advance.

DETAILED DESCRIPTION

Figure 1:
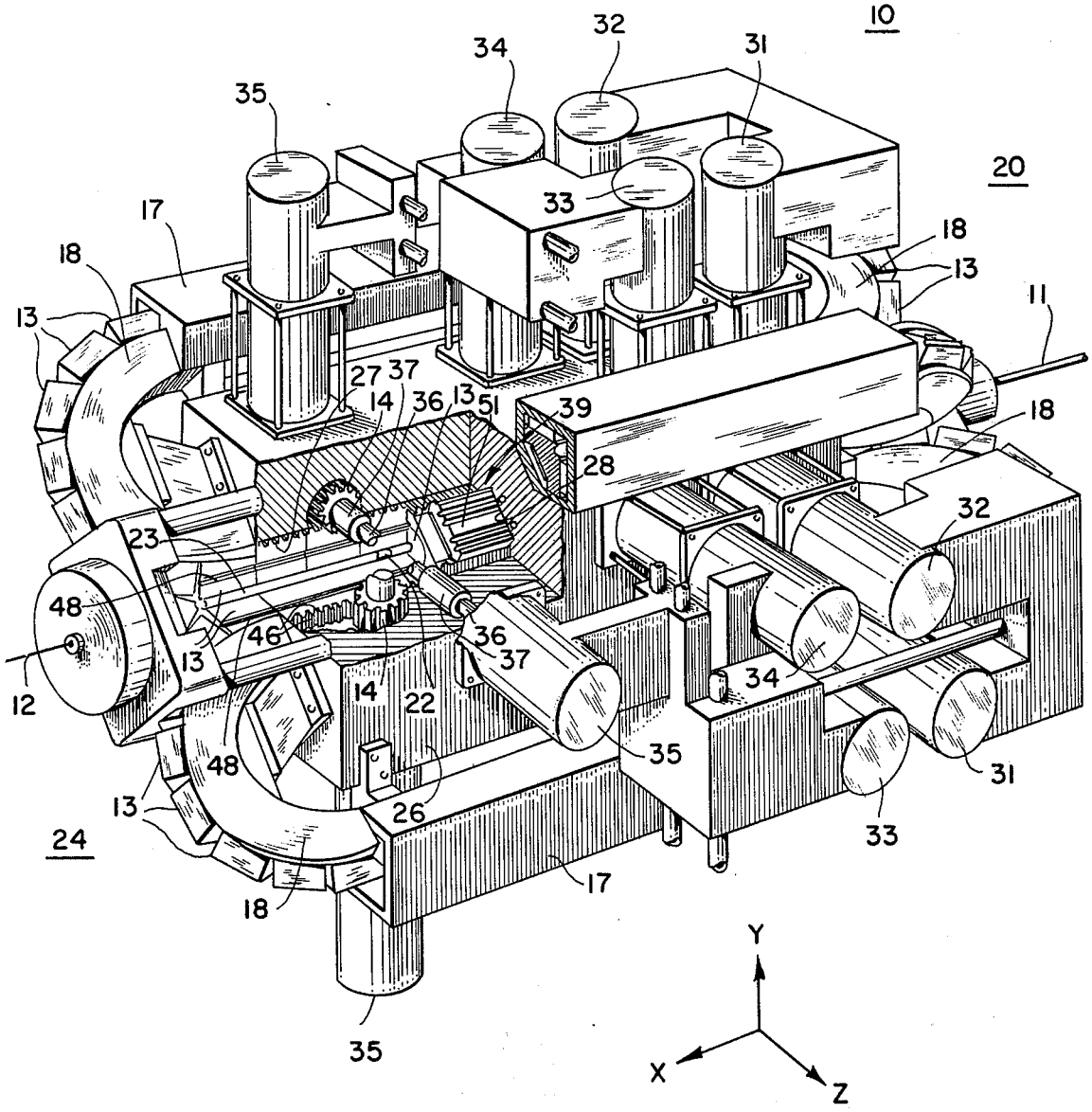
FIG. 1 of the drawing is an isometric view, with parts broken away, illustrating apparatus in accordance with the invention for continuously extruding rod into wire.

Referring initially to FIG. 1, apparatus 10 in accordance with the present invention is shown. The apparatus 10 may be utilized for the continuous and steady extrusion of an elongated workpiece of indefinite (i.e., unrestricted) length, such as rod 11, to form an elongated product, likewise of indefinite (i.e., unrestricted) length, such as wire 12.

Referring now also to FIGS. 3 through 6, the extrusion apparatus 10 is seen, generally, as comprising four groups or trains of gripping element quadrants 13. The gripping element quadrants of each train are adapted to be driven by a number of pinion gears 14 around an endless path 16 defined in part by straight lengths 17 and curved sections 18 of track. The paths of the four trains of gripping element quadrants 13 converge about the rod 11 emerging from a sizing and waxing assembly 19 (FIG. 4) at an entrance end 20 of the apparatus 10, so that successive sets of four gripping element quadrants, one from each train, cooperate to form a succession of gripping elements 21 (FIGS. 3 and 6) encircling successive portions of the surface of the waxed rod. The gripping elements 21 are adapted to function, in a manner which will hereinafter be described, to advance the waxed rod 11 to an "X" direction through an extrusion die 22 having a die stem 23, with the wire 12 resulting from such extrusion operation appearing at an exit end 24 of the apparatus 10, and the cooperating gripping element quadrants 13 diverging past (i.e., downstream of) the extrusion die 22 and proceeding along their respective endless paths 16. It will be seen, further, that the succession of gripping elements 21 between the entrance end 20 and the exit end 24 in effect constitutes a continuous, moving pressure chamber having, in effect, an endless wall advancing with the length of the rod in the apparatus.

Figure 5:
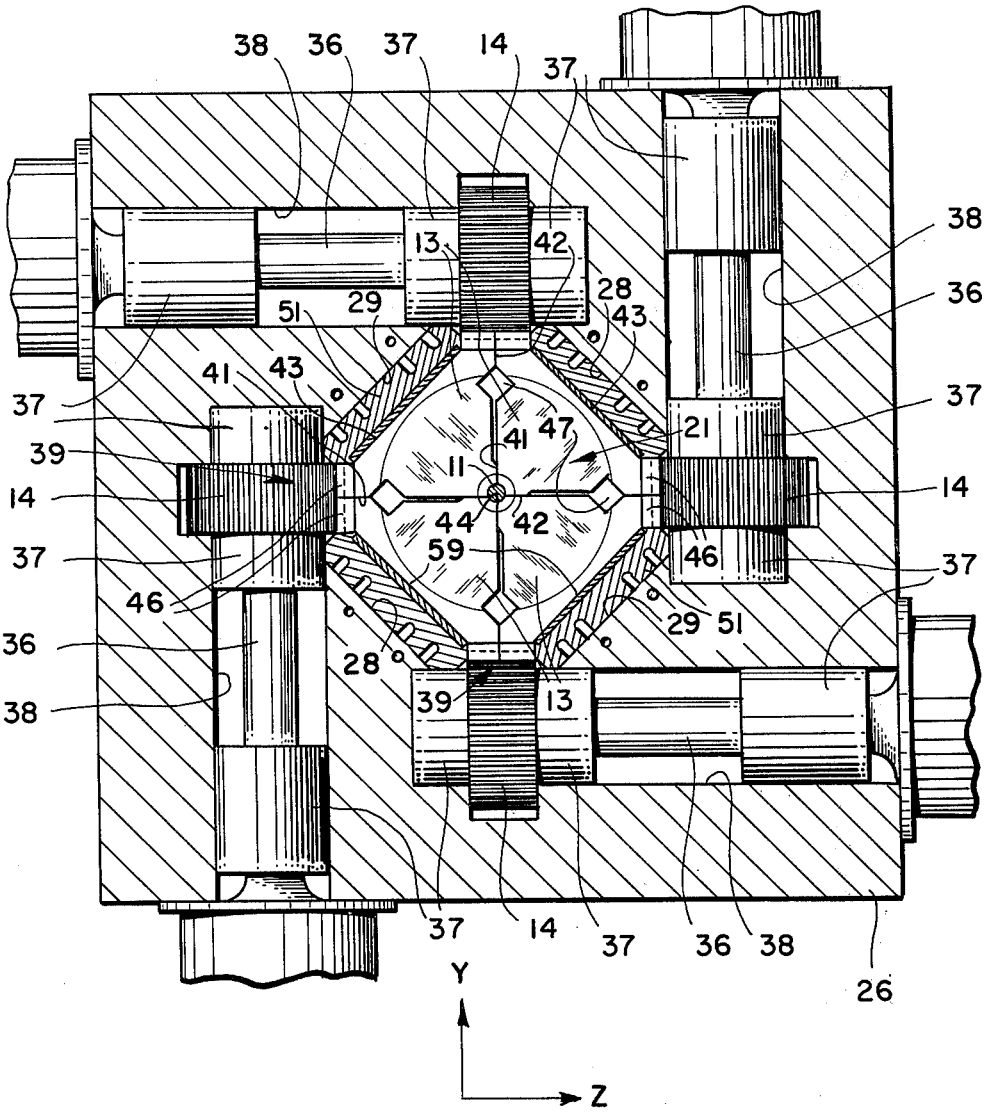
FIG. 5 is an enlarged transverse section through a portion of the apparatus.
Figure 6:
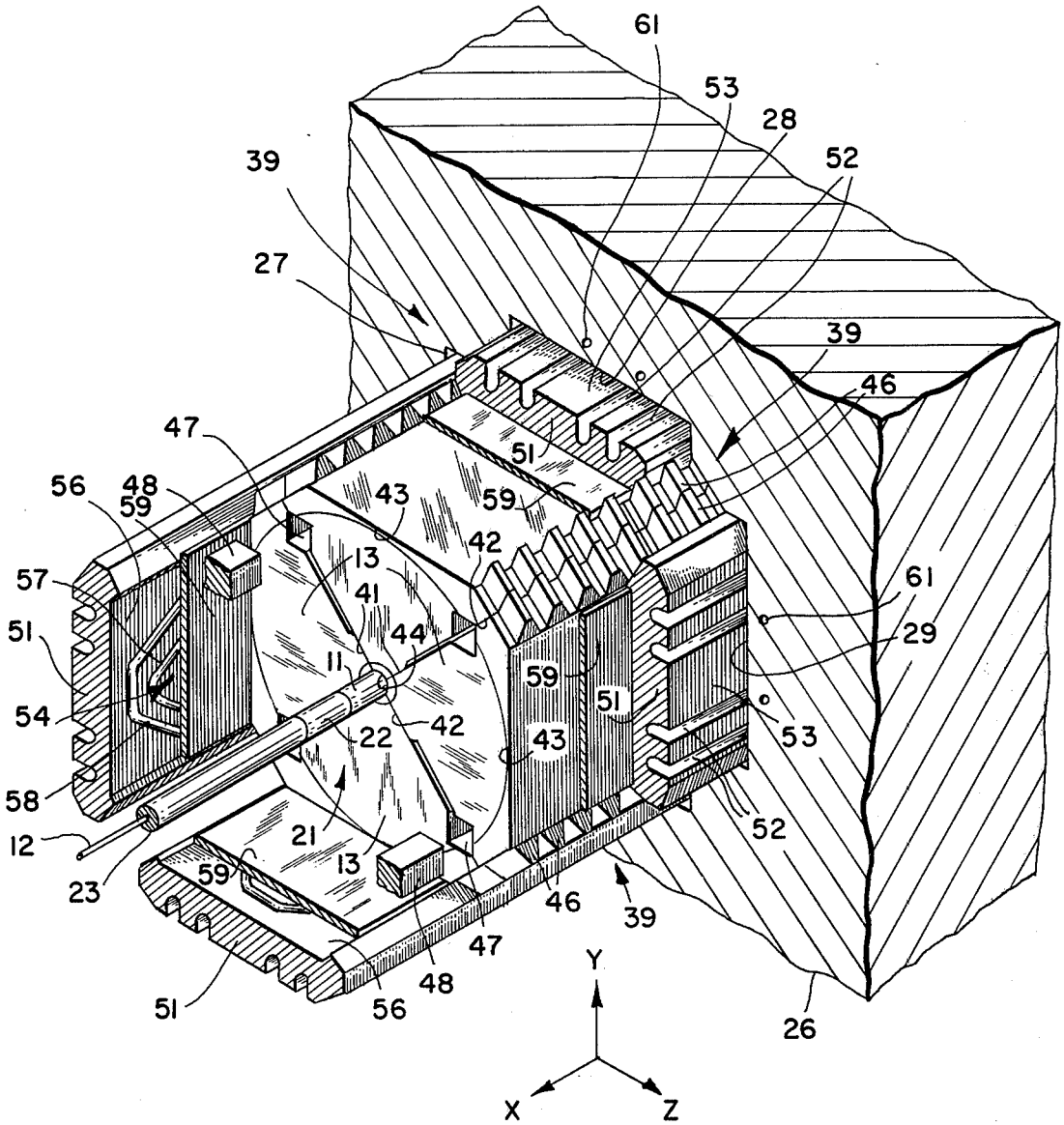
FIG. 6 is an enlarged, fragmentary, isometric view, showing the gripping element quadrants surrounding and engaging the rod, portions of pressure pads and of the belts adjacent the exterior surfaces of the gripping element quadrants, and the die and die stem, this figure being rotated 45° relative to FIG. 1 to show certain details more clearly.

Referring to FIGS. 1, 5 and 6, the apparatus 10 will next be described in greater detail. A block 26 is provided with a generally square, central aperture 27 extending longitudinally thereof along the X direction from the entrance end 20 to the exit end 24 of the apparatus. The aperture 27 is bordered, for the most part, by two flat, parallel, opposed walls 28 and two flat, parallel, opposed walls 29.

Four hydraulic motors 31, preferably coupled to be driven in unison from a common supply of pressurized motive fluid (not shown) are mounted on the block 26 in a common plane, perpendicular to the X direction, adjacent to the entrance end 20 of the apparatus 10. Several additional sets of four hydraulic motors each, e.g., 32, 33, 34, preferably also coupled to be driven in unison from the common supply of pressurized motive fluid (not shown), are mounted on the block 26 in parallel planes, each perpendicular to the X direction, adjacent to the motors 31. Four more hydraulic motors 35, preferably also coupled to be driven in unison from the common supply of pressurized motive fluid (not shown), are mounted on the block 26 in a common plane, perpendicular to the X direction, adjacent to the exit end 24 of the apparatus. The various hydraulic motors 31, 32, 33, 34, 35 are preferably reversible, so as to be used as pumps where appropriate. Each hydraulic motor 31, 32, 33, 34 or 35 has an output shaft 36 (FIG. 5) rotatably mounted in bearings 37 positioned in a bore 38 formed in the block 26. Each shaft 36 has mounted thereon one of the pinion gears 14, the teeth of which extend into the central aperture 27 along a junction area 39 between a pair of adjacent walls 28 and 29.

Figure 3:
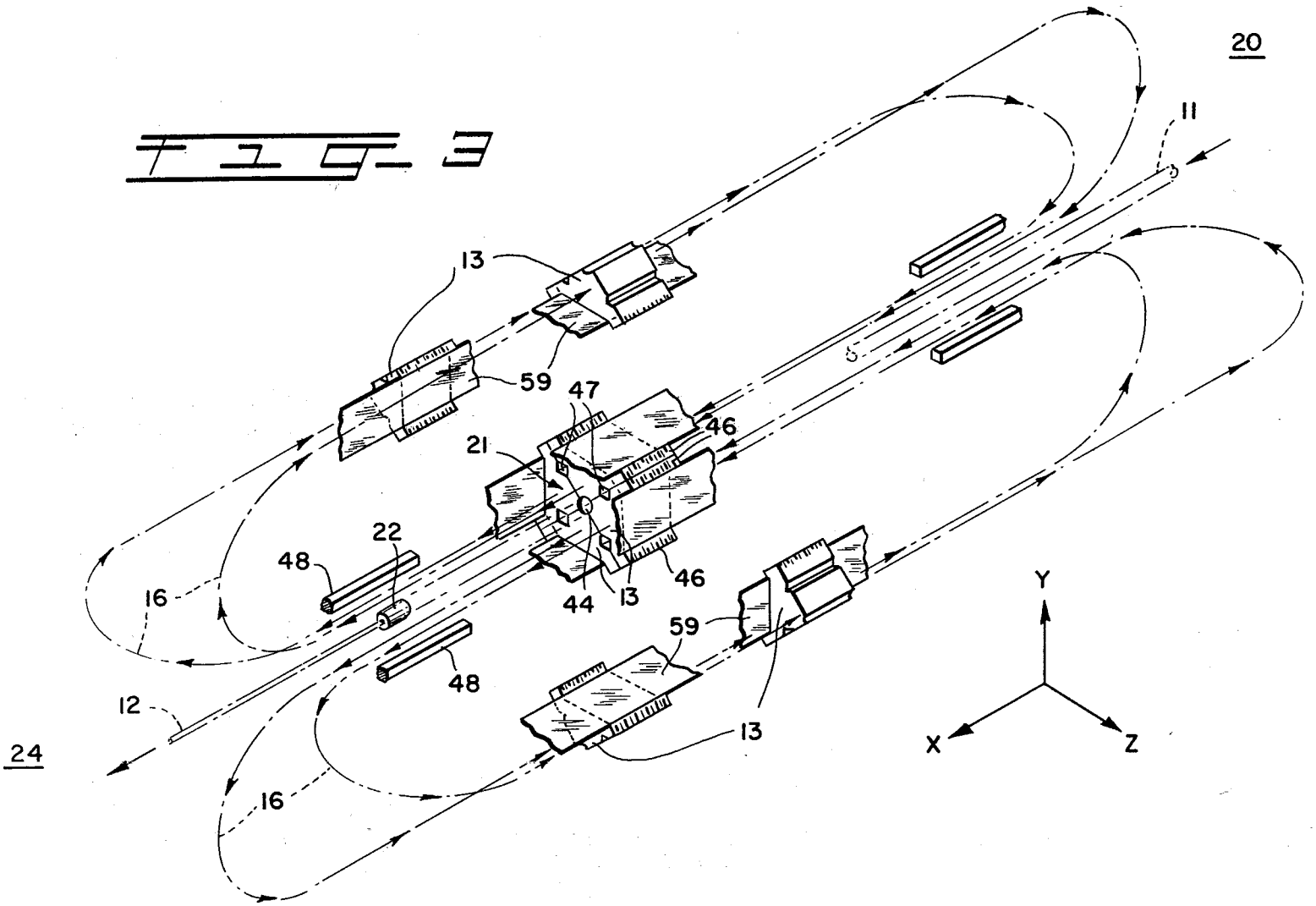
FIG. 3 is a diagrammatic view in perspective depicting the paths of four gripping element quadrants and belts in relation to the rod and to an extrusion die.

As may be seen in FIGS. 3, 5 and 6, each gripping element quadrant 13 takes the form, basically, of a prism with a cross-sectional shape, in a Y-Z plane perpendicular to the X direction, generally resembling a right-angled isosceles triangular having equal sides 41 and 42 and a base 43. Each gripping element 21 is formed by four such gripping element quadrants, one from each train of quadrants, which are brought together along adjacent sides 41 and 42. With the four gripping elements quadrants 13 so converged to form a gripping element 21, an aperture 44 extends through the center of the gripping element perpendicularly to the Y-Z plane, along the region where the right angles of the four mated isosceles triangles intersect. The size and configuration of the central aperture 44 correspond closely to the size and configuration of the waxed rod 11.

Land areas 45 are preferably formed on each gripping element quadrant 13 in the region surrounding the central aperture 44. These land areas provide for intimate contact between successive gripping elements 21 about the waxed rod 11, while providing a contact area of limited size in order that any high-pressure fluid which might leak into the contact area might exert only a limited force tending to separate the successive gripping elements along the X direction.

Along each corner of each gripping element quadrant 13 other than at the central aperture 44, i.e., along each corner where a side 41 and 42 joins the base 43 of an isosceles triangle, a succession of teeth 46 extends perpendicularly to the Y-Z plane. The lateral span of each tooth 46 is approximately one-half the width of the teeth of the pinion gears 14. As is illustrated in FIGS. 5 and 6, the arrangement is such that the succession of teeth 46 located along a side 41 of one gripping element quadrant 13 and the succession of teeth 46 located along the mating side 42 of an adjacent gripping element quadrant 13 lie in a side-by-side relationship. The teeth 46 at the neighboring corners of the two adjacent gripping element quadrants 13 are to be contacted simultaneously and driven in unison by a commn pinion gear 14, the pinion gear acting to key the quadrants together during their advance through the aperture 27 within the block 26 so as to prevent either of the quadrants from lagging the other during such advance. Additional hydraulic motors and pinion gears may be employed to drive the four trains of gripping element quadrants 13 along the straight lengths 17 and/or the curved sections 18 of track outside of the block 26, while suitable scrapers for degreasing the gripping element quadrants may also be located conveniently along the straight lengths 17 of track.

Figure 2:
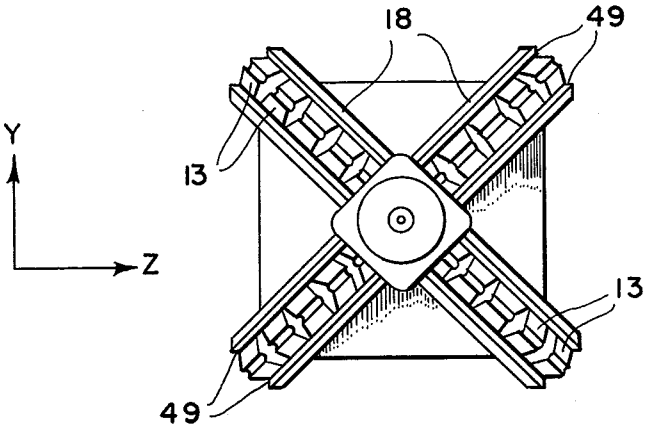
FIG. 2 is a partially diagrammatic view in elevation showing certain elements located at the left or exit end of the apparatus of FIG. 1.
Figure 4:
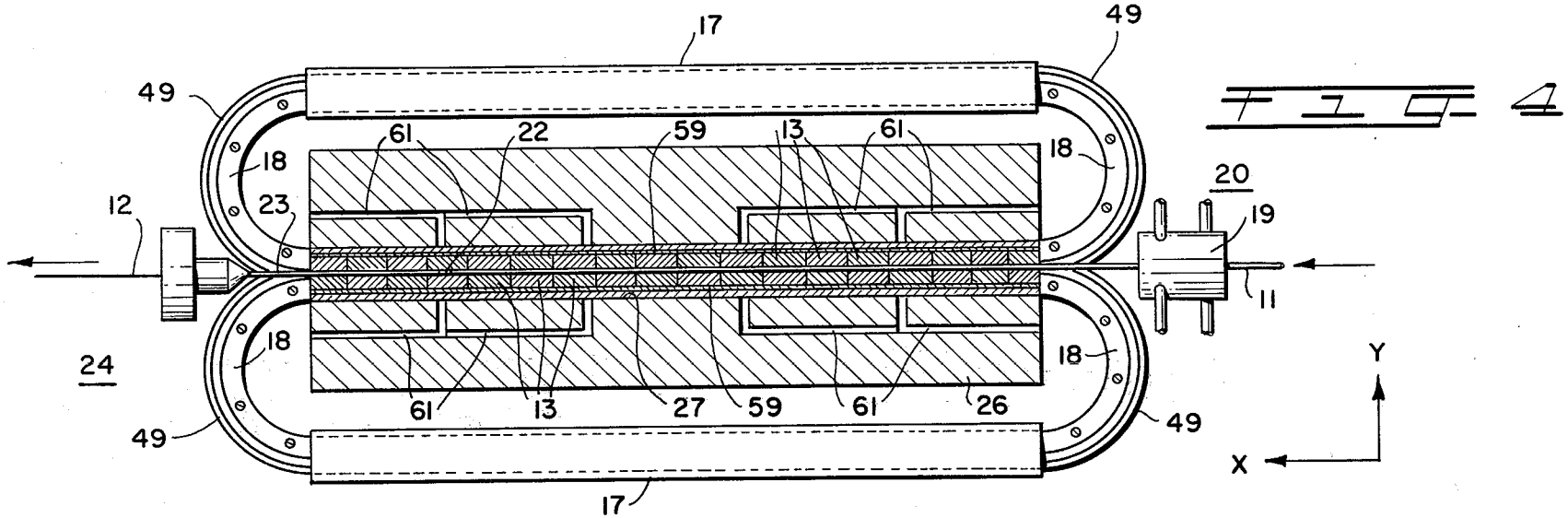
FIG. 4 represents a longitudinal view, partially in section and partially diagrammatic, of the apparatus of FIG. 1, with certain features, e.g., pinion gears, omitted for the purpose of clarity.

Four preferably square apertures 47 extend through each gripping element 21 perpendicularly to the Y-Z plane in locations slightly radially inward toward the central aperture 44 from the teeth 46. Each square aperture 47 is formed by two facing V-shaped grooves, one in each side of a pair of adjacent gripping element quadrant sides 41 and 42. The square apertures 47 are dimensioned to correspond closely to the outer dimensions of four guide elements 48, which extend in the X direction through the aperture 27 in the block 26 between the entrance end 20 and the exit end 24 of the apparatus 10, such that the precise orientation and location of the gripping elements 21 will be fixed, during their traverse through the aperture 27, by the guide elements 48. Additional guide elements 49 (FIGS. 2 and 4) are adapted to cooperate with the straight lengths 17 ~~and curved~~ sections 18 of track to guide the various gripping element quadrants 13 along the endless paths 16 externally of the block 26 by interacting with the V-shaped grooves along the quadrant sides 41 and 42.

Figure 8:
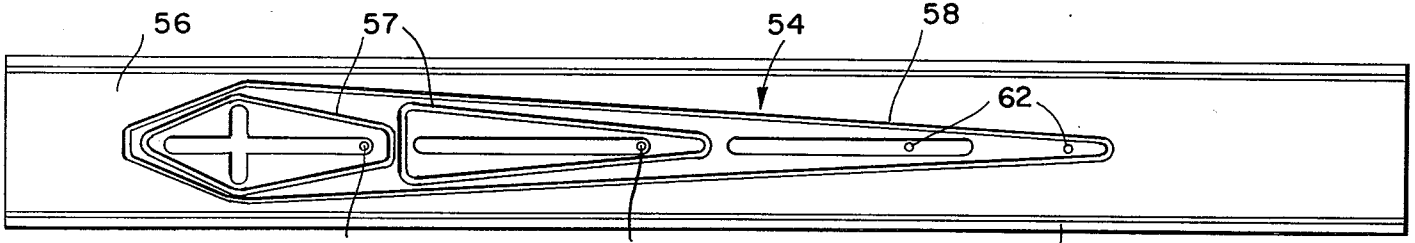
FIG. 8 is a plan view of an inner face of a pressure pad including seals associated therewith.
Figure 9:
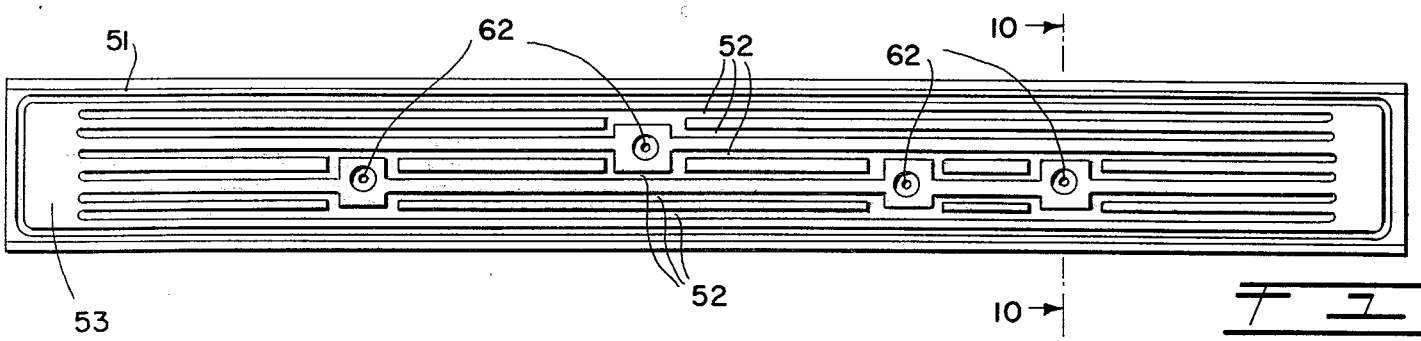
FIG. 9 is a plan view of the outer face of the pressure pad of FIG. 8, showing cooling channels associated with such outer face.

Four pressure pads 51 (FIG. 6) extend along the walls 28 and 29 of the aperture 27 within the block 26, radially outwardly from the gripping element quadrants, from the entrance end 20 to the exit end 24 of the apparatus 10. Each pressure pad 51 extends laterally across an entire wall 28 and 29 between neighboring junction areas 39. A number of cooling channels 52 (FIG. 9) extend along an outer face 53 of the pressure pad adjacent to the associated wall 28 or 29 and are adapted for the circulation of a coolant from a source (not shown). A seal assembly 54 (FIG. 8) is located along an inner face 56 of the pressure pad. The seal assembly 54 may be seen to include a number of inner seals 57 surrounded by an outer seal 58.

Four endless belts 59 (FIGS. 3 and 6) extend through the aperture 27 in the block 26 along the inner faces 56 of the pressure pads 51. The endless belts are composed of a material, such as a steel alloy, capable of withstanding high pressures, temperatures and friction forces. Each belt 59 extends in the X direction along successive base portions 43 of one train of gripping element quadrants 13 and preferably covers substantially the entire lateral span between the teeth 46 adjacent to the sides 41 and 42 of each quadrant in the train. The arrangement is such that four belts 59 will be driven by frictional engagement with the gripping element quadrants 13, each traveling about an endless path, generally following one of the four endless paths 16 of the gripping element quadrants 13, but preferably separated from such endless path 16 along a portion thereof, exterior to the block 26, so as to permit enhanced cooling of both the belt and the associated gripping element quadrant. The endless belts 59 serve to transmit gripping pressure from the stationary pressure pads 51 to the moving gripping element quadrants 13 as the belts advance with the quadrants through the block 26. The belts 59 provide readily replaceable wear surfaces intermediate the pressure pads and the gripping element quadrants. Suitable mechanisms for waxing the belts 59 may be incorporated along any convenient portion of the paths of the belts, e.g., in the area of the straight lengths 17 of track.

Figure 10:
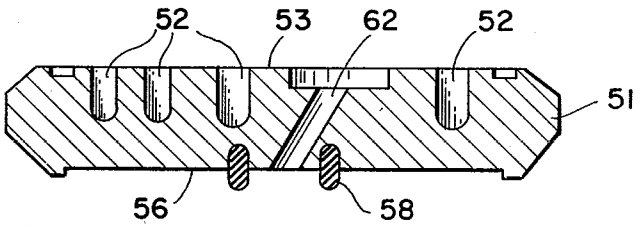
FIG. 10 is a transverse sectional view of the pressure pad taken along the line 10—10 of FIG. 9.

Gripping pressure may be provided to the endless belts by means of a high pressure fluid, e.g., a grease, transmitted from a source (not shown) through a number of passageways 61 (FIG. 6) within the block 26 and a number of additional passageways 62 (FIGS. 8 and 10) through the pressure pads 51 which communicate with the seal assemblies 54, the coolant and the high-pressure fluid being kept separated by conventional seals. The arrangement is preferably such that the fluid pressure increases within each successive passageway 62 and each successive inner seal 57 in the X direction from the entrance end 20 of the apparatus 10 toward the exit end 24, i.e., in the direction of travel of the waxed rod 11. The outer seals 58 have been found advantageously in providing an intermediate pressure zone between the various inner seals 57 and the area surrounding the seal assemblies 54, reducing any tendency toward leakage of the high pressure fluid.

Figure 11:
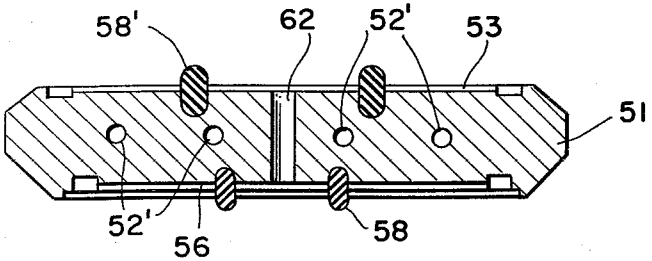
FIG. 11 is a transverse sectional view of an alternative pressure pad.

An alternative seal arrangement, shown in FIG. 11 of the drawing, also useable with the apparatus of the invention, includes additional seal assemblies along the outer faces 53 of the pressure pads 51. Internal coolant passageways 52' replace the cooling channels 52. The arrangement is such that additional seals 58' on the outer faces 53 of the pressure pads 51 surround larger areas than do the seals 58 on the inner faces 56. As a result, the pressure pads are biased radially inwardly into firm engagement with the gripping element quadrants 13 upon introduction of high pressure fluid into the passageways 61 and 62. This will cause the pressure pads 51 to press at their edges against the edges of the teeth 46 on the gripping element quadrants 13, thereby preventing any tilting or rocking of the quadrants about the axis of the rod 11.

It is shown in the art that many metals and other materials increase in ductility, or have an increased capacity for deformation without fracture, when they are subjected to high pressure. This effect is known as the "Bridgman Effect," and the principle is treated in "Large Plastic Flow and Fracture" by P. W. Bridgman, published by McGraw Hill (New York, 1952). The present invention is particularly adapted to subject the rod 11 to such high pressures. For example, when the rod 11 is of aluminum, the apparatus 10 may be designed so that pressure on the rod 11 adjacent to the die 22 will be approximately 150,000 psi, and where the rod 11 is of copper, the apparatus 10 may be designed so that pressure on the rod 11 adjacent to the die 22 will be approximately 250,000 psi. These pressures are far above the respective yield strengths of aluminum and copper, and will increase the ductility, or capacity for deformation without fracture, of these materials.

Figure 7:
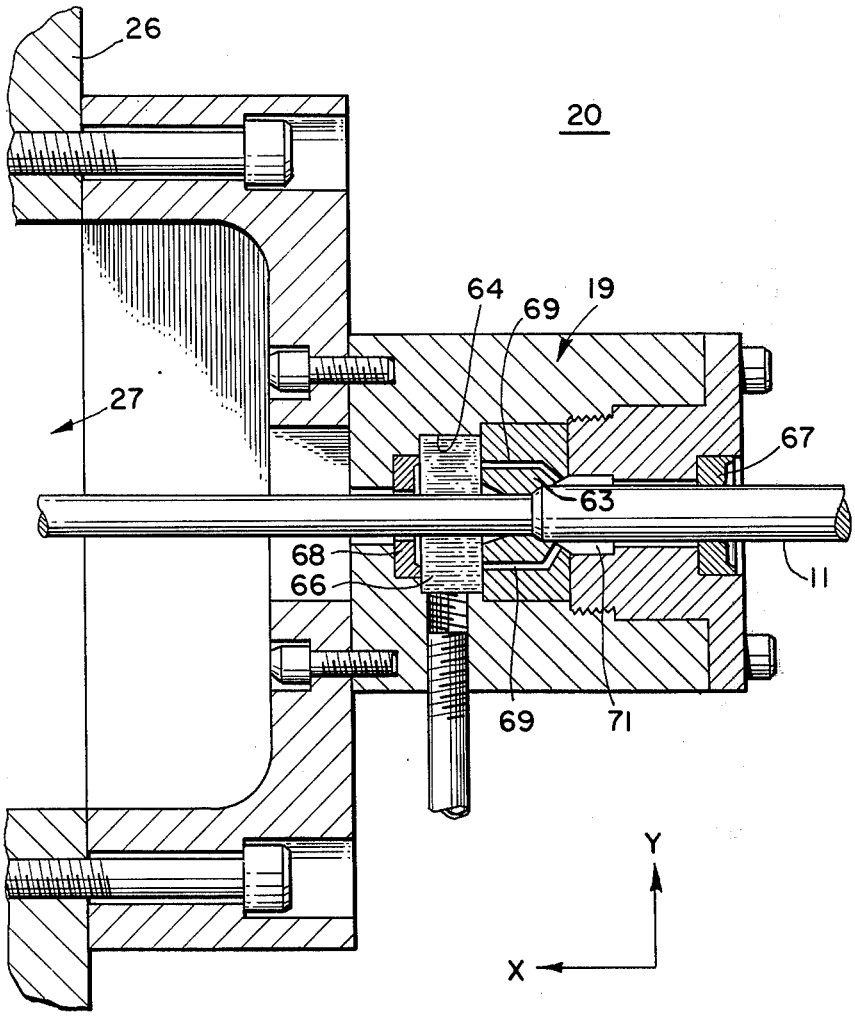
FIG. 7 is a longitudinal section through a sizing and waxing assembly located at the right or entrance end of the apparatus of FIG. 1.

Referring now to FIG. 7 of the drawing, the sizing and waxing assembly 19 includes a sizing die 63 located upstream of a waxing chamber 64. A suitable shear transmitting medium 66 is continually introduced from a source (not shown) into the chamber 64. The shear transmitting medium which may be utilized in practicing the present invention will desirably have a high viscosity and shear strength, be capable of lubricating the dies 22 and 63, provide good wetting action on the rod 11, and have minimal viscosity variation with respect to pressure, temperature and shearing rate. Such a medium may otherwise be known as viscous fluid, and examples of such a suitable medium are beeswax and polyethylene wax. Accordingly, the term "wax" is used herein to represent any such shear transmitting medium.

Also forming parts of the sizing and waxing assembly are a scraper 67 at the entrance to the assembly 19, a wiper 68 for removing excess wax from the rod 12 downstream of the waxing chamber 64, and associated housing and supporting structures. A number of channels 69 extend through the sizing die 63 from the waxing chamber 64 to a small entry chamber 71 in order to provide a lubricating coating of the wax 66 on the rod during the initial sizing of the rod.

In the operation of the apparatus previously described, and in carrying out the method of the invention, an initial length of the rod 11, preferably of reduced radius to facilitate passage through the dies 22 and 63, is first fed, e.g., manually, along the X direction from a source (not shown) into the sizing and waxing assembly 19, then into the aperture 27 within the block 26, and there into the region where the four trains of gripping element quadrants 13 converge to form the gripped elements 21. In its passage through the waxing chamber 64, the initial length of rod will have acquired a coating of the wax 66.

Once the initial length of the rod has been inserted for a sufficient distance into the central aperture 44 between several of the gripping elements, the various hydraulic motors 31, 32, 33, 34 and 35 are energized in order to rotate the associated pinion gears 14. It is considered advantageous that certain of the motors, such as the motors 35, be reversed, so as to operate as pumps, in order to maintain a sufficient back pressure downstream of the die 22 to clamp the gripping element quadrants 13 of each train together along the X direction so as to prevent leakage of the wax 66 between the quadrants. Such reversal of the motors 35 may be conveniently involve interconnecting the reversed motors 35 with certain of the motors 31, 32, 33 or 34, such that the reversed motors 35 will serve to drive, or assist in the driving of, the associated motors 31, 32, 33 or 34.

The four trains of gripping element quadrants 13 are advanced along the endless paths 16 by the rotating pinion gears 14, with the gripping elements 21 which surround the waxed rod 11 tending to grip and pull the waxed rod along with their advance in the X direction. The gripping elements are guided during such advance by the interaction between the guide elements 48 and the walls of the apertures 47. The rate of travel of the various trains of gripping element quadrants 13 through the block 26 is maintained uniform due to the keying action provided by each pinion gear 14 acting on the teeth 46 along the adjacent outer peripheries of two neighboring gripping element gradrants. Thus, any tendency for one of the quadrants to lag the others within the aperture 27 in the block 26 is avoided.

As each new element of the rod 11 advances in the X direction to the entrance end 20 of the apparatus 10, it first encounters the scraper 67 (FIG. 7) in entering the sizing and waxing assembly 19. The scraper serves to remove surface material, such as dust and dirt, from the advancing rod element. The rod element then acquires an initial wax coating in the small entry chamber 71, incurs an initial reduction in size in passing through the sizing die 63, is rewaxed in the waxing chamber 64, and finally has its wax coating reduced to a desired thickness by the wiper 68 as the rod element exits from the sizing and waxing assembly 19 and enters the central aperture 27 in the block 26. The size and configuration of the waxed element of the rod 11 now correspond closely to the size and configuration of the central aperture 44 which extends in the X direction through the center of the converged gripping elements 21.

The element of the rod 11 next advances into the region where the four trains of gripping element quadrants 13 converge. A set of four advancing quadrants comes together to form a gripping element 21 surrounding the waxed rod element. The four belts 59, meanwhile, contact the bases 43 of the four gripping element quadrants 13 which form the gripping element 21, advancing by virtue of frictional engagement with the quadrants, and serving to transmit gripping pressure to the quadrants from the four stationary pressure pads 51. Shear forces in the X direction are transmitted to the rod element to cause the rod element to continue to advance with the gripping element toward the die 22. At the same time, radial compressive forces applied by the gripping element quadrants 13 increase with X direction movement of the gripping elements due to the increasing fluid pressure level maintained within each successive passageway 62 and each successive inner seal 57 of the seal assemblies 54 on the pressure pads 51. Thus, the pressure applied through the wax coating on the rod element builds up to a sufficient level upstream of the die 22 to increase the ductility of the rod element substantially, whereupon the rod element is caused to pass through the die 22 and is hydrostatically extruded into an element of the wire 12. The gripping element 21 associated with the wire element so produced continues to advance about the advancing wire element to a location somewhat downstream of the die 22. At this point, the four component gripping element quadrants 13 diverge, each to follow its own endless path 16 back toward the entrance end 20 of the apparatus 10, and there to recombine with the other three quadrants to receive an additional element of the advancing rod 11.

It is to be understood that the described apparatus and methods are simply illustrated of a preferred embodiment of the invention. It should be clear that various other embodiments might also be utilized for a extruding or otherwise deforming rod or any other elongated workpiece of circular or other cross section in accordance with the principles of the invention. For example, alternative embodiments might incorporate fewer or more than four trains of gripping element members which travel about endless paths and which cooperate to form gripping elements for advancing an elongated workpiece of indefinite length to be deformed into an elongated product of indefinite length. Many other modifications might also be made within the scope of the invention.

What is claimed is:

1. Apparatus for continuously deforming an elongated workpiece of indefinite length to produce an elongated product of indefinite length, said apparatus comprising:

a. a deforming agency;

b. a plurality of trains of gripping element members;

c. A plurality of first means, each of said first means being operatively associated with one train of gripping element members, for providing an endless path for said train of gripping element members;

d. a plurality of second means, each of said second means engaging an adjacent pair of trains, for moving in unison each of said adjacent pair of trains of gripping element members around its respective endless path past a first station upstream of said deforming agency toward a second station downstream of said deforming agency, the first and second stations and the span therebetween being common to all of said plurality of endless paths;

e. the gripping element members in each of said plurality of moving trains of gripping element members being configured to cooperate with each other to form a centrally apertured chamber extending between and moving from said first station to said second station;

f. the moving chamber receiving the elongated workpiece in the central aperture thereof and being configured to continuously operatively engage the surface of the elongated workpiece for continuously applying motive force along the surface of the elongated workpiece in the direction of the deforming agency, whereby to continuously advance said elongated workpiece against said deforming agency and produce elongated product.

2. Apparatus as set forth in claim 1, wherein each of said second means comprises:

g. common driving means engaging adjacent peripheral areas on two adjacent trains of gripping element members for driving said two adjacent trains of gripping element members jointly.

3. Apparatus as set forth in claim 2, wherein:

h. each of said trains of gripping element members comprises a set of teeth along at least one peripheral area on the train of gripping element members; and i. said common driving means comprises gear means for engaging simultaneously the teeth along adjacent peripheral areas of two adjacent trains of gripping element members.

4. Apparatus as set forth in claim 1, further comprising:

g. a plurality of third means, extending along at least a part of the span between said first station and said second station and engaging simultaneously portions of the gripping element members in each of two adjacent trains of gripping element members, for guiding said gripping element members during movement between said first station and said second station.

5. Apparatus as set forth in claim 1, further comprising:

g. a plurality of endless belts, each being operatively associated with a different one of said trains of gripping element members and each disposed to advance with the associated train of gripping element members from said first station to said second station while contacting the gripping element members of said associated train along surfaces thereof remote from said endless central apertured chamber; and h. third means for applying sufficient pressure to said endless belts, and through said endless belts to said gripping element members, to produce a compressive stress gradient within said elongated workpiece increasing from said first station toward said deforming agency.

6. Apparatus as set forth in claim 5, further comprising:

i. a plurality of fourth means extending along at least a part of the span between said first station and said second station and engaging simultaneously portions of the gripping element members in each of two adjacent trains of gripping element members, for guiding said gripping element members during movement between said first station and said second station.

7. Apparatus as set forth in claim 5, said third means comprising:

i. a plurality of fluid passage means, communicating with a surface of each of said endless belts remote from the associated gripping element member at a plurality of spaced locations intermediate said first station and said second station, for applying pressurized fluid to each of said spaced locations; and j. a plurality of fixed seals each engaging one of said endless belts while surrounding a plurality of said spaced locations along said engaged endless belt to seal off flow of pressurized fluid around the seal as the endless belt advances past the seal.

8. Apparatus as set forth in claim 7, wherein each of said plurality of seals constitutes an outer seal, said third means further comprising:

k. a plurality of fixed inner seals, at least one engaging each of said endless belts, each located within one of said outer seals and surrounding at least one of said spaced locations along the engaged endless belt.

9. Apparatus as set forth in claim 8, wherein:

l. at least one of said outer seals surrounds a plurality of said inner seals; and m. said fluid passage means applies fluid at different pressures to at least two different surrounded inner seals.

10. Apparatus as set forth in claim 8, wherein at least one of said spaced locations is surrounded by only an outer seal.

11. Apparatus as set forth in claim 5, wherein:

i. each of said trains of gripping element members comprises a set of teeth along opposite sides of the train of gripping element members;

j. each of said second means comprises gear means for engaging simultaneously the teeth along adjacent peripheral areas of two adjacent trains of gripping element members for driving said two adjacent trains of gripping element members jointly;

k. each of said endless belts extends across the associated gripping element member between the teeth along opposite sides of the member;

l. said third means comprises a plurality of fluid passage means for applying said pressure to a surface of each of said endless belts remote from the associated gripping element member; and m. said third means further comprises a plurality of means, surrounding said fluid passage means and engaging said endless belts, for sealing said fluid passage means as the endless belts advance.

12. Apparatus as set forth in claim 11, further comprising:

n. a plurality of fourth means extending along at least a part of the span between said first station and said second station and engaging simultaneously portions of the gripping element members in each of two adjacent trains of gripping element members, for guiding said gripping element members during movement between said first station and said second station.

13. Apparatus for continuously deforming an elongated workpiece of indefinite length to produce an elongated product of indefinite length, said apparatus comprising:

a. a deforming agency;

b. a plurality of trains of griping element members;

c. a plurality of first means, each of said first means being operatively associated with one train of gripping element members for providing an endless path for said train of gripping element members;

d. a plurality of second means for moving each of said trains of gripping element members around its respective endless path past a first station upstream of said deforming agency toward a second station downstream of said deforming agency, the first and second stations and the span therebetween being common to all of said plurality of endless paths;

e. the gripping element members in each of said plurality of moving trains of gripping element members being configured to cooperate with each other to form a centrally apertured chamber extending between and moving from said first station to said second station;

f. the moving chamber receiving the elongated workpiece in the central aperture thereof and being configured to continuously operatively engage the surface of the elongated workpiece for continuously applying motive force along the surface of the elongated workpiece in the direction of the deforming agency, whereby to continuously advance said elongated workpiece against said deforming agency and produce elongated product;

g. a plurality of endless belts, each being operatively associated with a different one of said trains of gripping element members and each disposed to advance with the associated train of gripping element members from said first station to said second station while contacting the gripping element members of said associated train along surfaces thereof remote from said endless central apertured chamber; and h. third means for applying sufficient pressure to said endless belts, and through said endless belts to said gripping element members, to produce a compressive stress gradient within said elongated workpiece increasing from said first station toward said deforming agency.

14. Apparatus as set forth in claim 13, said third means comprising:

i. a plurality of fluid passage means, communicating with a surface of each of said endless belts remote from the associated gripping element member at a plurality of spaced locations intermediate said first station and said second station, for applying pressurized fluid to each of said spaced locations; and j. a plurality of fixed seals each engaging one of said endless belts while surrounding a plurality of said spaced locations along said engaged endless belt to seal off flow of pressurized fluid around the seal as the endless belt advances past the seal.

15. Apparatus as set forth in claim 14, wherein each of said plurality of seals constitutes an outer seal, said third means further comprising:

k. a plurality of fixed inner seals, at least one engaging each of said endless belts, each located within one of said outer seals and surrounding at least one of said spaced locations along the engaged endless belt.

16. Apparatus as set forth in claim 15, wherein;

l. at least one of said outer seals surrounds a plurality of said inner seals; and m. said fluid passage means applies fluid at different pressures to at least two different surrounded inner seals.

17. Apparatus as set forth in claim 15, wherein at least one of said spaced locations is surrounded by only an outer seal.

18. Apparatus as set forth in claim 13, wherein:

i. each of said trains of gripping element members comprises a set of teeth along opposite sides of the train of gripping element members;

j. each of said second means comprises gear means for engaging simultaneously the teeth along adjacent peripheral areas of two adjacent trains of gripping element members for driving said two adjacent trains of gripping element members jointly;

k. each of said endless belts extends across the associated gripping element member between the teeth along opposite sides of the member;

l. said third means comprises a plurality of fluid passage means for applying said pressure to a surface of each of said endless belts remote from the associated gripping element member; and m. said third means further comprises a plurality of means, surrounding said fluid passage means and engaging said endless belts, for sealing said fluid passage means as the endless belts advance.

19. Apparatus as set forth in claim 13, each of said plurality of second means comprising:

i. common driving means engaging an adjacent pair of trains of gripping element members for moving in unison each of said adjacent pair of trains of gripping element members around its respective endless path.

20. Apparatus as set forth in claim 19, wherein each of said second means further comprises;

j. said common driving means engaging adjacent peripheral areas on two adjacent trains of gripping element members for driving said two adjacent trains of gripping element members jointly.

21. Apparatus as set forth in claim 20, wherein:

k. each of said trains of gripping element members comprises a set of teeth along at least one peripheral area on the train of gripping element members; and l. said common driving means comprises gear means for engaging simultaneously the teeth along adjacent peripheral areas of two adjacent trains of gripping element members.

22. Apparatus as set forth in claim 13, further comprising:

i. a plurality of fourth means, extending along at least a part of the span between said first station and said second station and engaging simultaneously portions of the gripping element members in each of two adjacent trains of gripping element members, for guiding said gripping element members during movement between said first station and said second station.

23. Apparatus as set forth in claim 22, each of said plurality of second means comprising:

j. common driving means engaging an adjacent pair of trains of gripping element members for moving in unison each of said adjacent pair of trains of gripping element members around its respective endless path.

24. Apparatus as set forth in claim 23, wherein each of said second means further comprises:

k. said common driving means engaging adjacent peripheral areas on two adjacent trains of gripping element members for driving said two adjacent trains of gripping element members jointly.

25. Apparatus as set forth in claim 24, wherein:

l. each of said trains of gripping element members comprises a set of teeth along at least one peripheral area on the train of gripping element members; and m. said common driving means comprises gear means for engaging simultaneously the teeth along adjacent peripheral areas of two adjacent trains of gripping element members.

26. A method of continuously deforming an elongated workpiece of indefinite length to produce an elongated product of indefinite length, said method comprising:

a. providing a plurality of trains of gripping element members;

b. arraying each of said plurality of trains of gripping element members around an endless path, including a first station common to all of said trains of gripping element members and located upstream of a deforming agency, and a second station common to all of said trains of gripping element members and located downstream of said deforming agency, with the gripping element members of each of said trains cooperatively associated to form a chamber extending between said first station and said second station;

c. engaging, with the gripping element members of each adjacent pair of trains of gripping element members, a different one of a plurality of driving members;

d. operating all of said driving members simultaneously, such that the engagement, with the gripping element members of each adjacent pair of gripping element members, of a different driving member causes the trains of gripping element members to move in unison so as to advance said chamber from said first station past said deforming agency and toward said second section;

e. placing the interior of said chamber in continuous operative engagement with said elongated workpiece between said first station and said deforming agency so as to apply motive force continuously to said elongated workpiece in the direction of said deforming agency; and f. continuously advancing said elongated workpiece against said deforming agency by means of said motive force to produce an elongated product.

27. A method as set forth in claim 26, wherein step (c) further comprises:

g. engaging each adjacent pair of trains of gripping element members between said first station and said second station with a common driving member for driving both trains of each of said adjacent pair in unison.

28. A method as set forth in claim 27, wherein said step (c) further comprises:

g. engaging each adjacent pair of trains of gripping element members between said first station and said deforming agency with said common driving member.

29. A method as set forth in claim 27, wherein said step (c) further comprises:

g. engaging each adjacent pair of trains of gripping element members between said deforming agency and said second station with said common member.

30. A method as set forth in claim 27, wherein said step (c) further comprises:

g. engaging each adjacent pair of trains of gripping element members between said first station and said deforming agency with a common driving member; while also, h. engaging each adjacent pair of trains of gripping element members between said deforming agency and said second station with a common driving member.

31. A method as set forth in claim 26, further comprising:

g. providing a plurality of elongated guide elements extending between said first station and said second station; and h. engaging with each of said elongated guide elements, portions of the gripping element members in each of two adjacent trains of gripping element members such that the elongated guide elements maintain the cooperative association of the gripping element members during movement between said first station and said second station.

32. A method as set forth in claim 31, wherein step (a) further comprises:

i. providing said plurality of trains of gripping element members with each gripping element member having at least one peripheral recessed area disposed to engage with one of said elongated guide elements so as to be guided thereby during movement between said first station and said second station.

33. A method as set forth in claim 26, further comprising:

g. advancing a plurality of endless belts, each being operatively associated with a different one of said trains of gripping element members, with the advancing trains of gripping element members from said first station to said second station, with each of said endless belts contacting the gripping element members of the associated train along surfaces thereof remote from said endless central apertured chamber; and h. applying sufficient pressure to said endless belts, and through said endless belts to said gripping element members, to produce a compressive stress gradient within said advancing elongated workpiece increasing from said first station toward said deforming agency.

34. A method as set forth in claim 33, further comprising:

i. providing a plurality of elongated guide elements extending between said first station and said second station; and j. engaging with each of said elongated guide elements, portions of the gripping element members in each of two adjacent trains of gripping element members such that the elongated guide elements maintain the cooperative association of the gripping element members during movement between said first station and said second station.

35. A method of continuously deforming an elongated workpiece of indefinite length to produce an elongated product of indefinite length, said method comprising:

a. providing a plurality of trains of gripping element members;

b. continuously moving each of said plurality of trains of gripping element members around an endless path, including a first station common to all of said trains of gripping element members and located upstream of a deforming agency, and a second station common to all of said trains of gripping element members and located downstream of said deforming agency, whereby to provide a plurality of endless paths of gripping element members:

c. cooperatively associating gripping element members in each of said plurality of trains at said first station to form a chamber and continuing said cooperation as said plurality of trains moves past said deforming agency toward said second section;

d. placing the interior of said chamber in continuous operative engagement with said elongated workpiece between said first station and said deforming agency so as to apply motive force continuously to said elongated workpiece in the direction of said deforming agency;

e. continuously advancing said elongated workpiece against said deforming agency by means of said motive force to produce elongated product;

f. advancing a plurality of endless belts, each being operatively associated with a different one of said trains of gripping element members, with the advancing trains of gripping element members from said first station to said second station, with each of said endless belts contacting the gripping element members of the associated train along surfaces thereof remote from said endless central apertured chamber; and g. applying sufficient pressure to said endless belts, and through said endless belts to said gripping element members, to produce a compressive stress gradient within said advancing elongated workpiece increasing from said first station toward said deforming agency.

36. A method as set forth in claim 35, further comprising performing steps (b) and (c) by:

h. engaging each adjacent pair of trains of gripping element members between said first station and said second station with a common driving member for driving both trains of said adjacent pair in unison; and i. operating all of said common driving members in unison, whereby to drive all of said trains of gripping element members in unison from said first station past said deforming agency and toward said second station.

37. A method as set forth in claim 35, step (c) further comprising:

h. providing a plurality of elongated guide elements extending between said first station and said second station; and i. engaging with each of said elongated guide elements, portions of the gripping element members in each of two adjacent trains of gripping element members such that the elongated guide elements maintain the cooperative association of the gripping element members during movement between said first station and said second station.

38. A method as set forth in claim 37, wherein step (a) further comprises:

j. providing said plurality of trains of gripping element members with each gripping element member having at least one peripheral recessed area disposed to engage with one of said elongated guide elements so as to be guided by said engaged elongated guide element during movement between said first station and said second station.

39. A method as set forth in claim 37, further comprising, performing steps (b) and (c) by:

k. engaging each adjacent pair of trains of gripping element members between said first station and said second station with a common driving member for driving both trains of each of said adjacent pair in unison; and l. operating all of said common driving members in unison, whereby to drive all of said trains of gripping element members in unison from said first station past said deforming agency and toward said second station.

* * * * *